US009229412B2

(12) United States Patent
Amita et al.

(10) Patent No.: US 9,229,412 B2
(45) Date of Patent: Jan. 5, 2016

(54) GLOSS APPLIER AND IMAGE FORMING APPARATUS INCORPORATING SAME

(75) Inventors: Akiyasu Amita, Kanagawa (JP); Hiroyuki Kunii, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 185 days.

(21) Appl. No.: 13/369,589

(22) Filed: Feb. 9, 2012

(65) Prior Publication Data

US 2012/0224898 A1 Sep. 6, 2012

(30) Foreign Application Priority Data

Mar. 1, 2011 (JP) ..... 2011-043958

(51) Int. Cl.
*G03G 15/20* (2006.01)
*G03G 15/00* (2006.01)

(52) U.S. Cl.
CPC ..... *G03G 15/6585* (2013.01); *G03G 15/2021* (2013.01); *G03G 2215/00949* (2013.01); *G03G 2215/0141* (2013.01)

(58) Field of Classification Search
CPC ..... G03G 15/2078; G03G 15/2039; G03G 15/6585; G03G 15/2021; G03G 2215/00949; G03G 2215/0141
USPC ..... 399/69, 341
See application file for complete search history.

(56) References Cited

U.S. PATENT DOCUMENTS 5,099,288 A * 3/1992 Britto et al. ..... 399/320
6,813,464 B2 11/2004 Amita et al.
6,957,036 B2 10/2005 Kikuchi et al.
7,010,257 B2 3/2006 Someya et al.
7,024,148 B2 * 4/2006 Uehara et al. ..... 399/341
7,031,648 B2 4/2006 Takashi et al.
7,054,570 B2 5/2006 Kishi et al.
7,116,923 B2 10/2006 Kishi et al.

(Continued)

FOREIGN PATENT DOCUMENTS

JP 05-027629 A 2/1993
JP 05-107960 A 4/1993

(Continued)

OTHER PUBLICATIONS

"Gloss" [Def. 1 and 2]. In Webster's Seventh New Collegiate Dictionary, Merriam-Webster, 1963.*

(Continued)

*Primary Examiner* — Ryan Walsh
*Assistant Examiner* — Philip Marcus T Fadul
(74) *Attorney, Agent, or Firm* — Harness, Dickey & Pierce, P.L.C.

(57) ABSTRACT

A gloss applier includes a heating roller disposed inside a loop formed by an endless belt to heat the endless belt; a pressing rotary body pressed against the heating roller via the endless belt; a cooler disposed inside the loop formed by the endless belt and downstream from the heating roller in a direction of rotation of the endless belt, the cooler to cool the endless belt as a recording medium in contact with the endless belt is conveyed by the endless belt; a separation roller disposed inside the loop formed by the endless belt and downstream from the cooler in the direction of rotation of the endless belt, the separation roller to separate the recording medium from the endless belt; and a cooler shifter contacting the cooler to move the cooler bidirectionally to cause the cooler to contact and separate from the endless belt.

10 Claims, 4 Drawing Sheets

(56) References Cited

U.S. PATENT DOCUMENTS

| | | | | |
|---|---|---|---|---|
| 7,127,202 | B2 | 10/2006 | Fujita et al. | |
| 7,130,555 | B2 | 10/2006 | Kishi et al. | |
| 7,139,520 | B2 | 11/2006 | Echigo et al. | |
| 7,177,580 | B2 | 2/2007 | Nakafuji et al. | |
| 7,209,675 | B2 | 4/2007 | Matsusaka et al. | |
| 7,212,759 | B2 | 5/2007 | Kishi et a | |
| 7,233,762 | B2 | 6/2007 | Kunii et al. | |
| 7,239,821 | B2 | 7/2007 | Matsusaka et al. | |
| 7,242,881 | B2 * | 7/2007 | Taki et al. | 399/45 |
| 7,254,362 | B2 | 8/2007 | Kikuchi et al. | |
| 7,299,003 | B2 | 11/2007 | Kurotaka et al. | |
| 7,333,760 | B2 | 2/2008 | Baba et al. | |
| 7,496,309 | B2 | 2/2009 | Matsusaka et al. | |
| 7,565,087 | B2 | 7/2009 | Matsusaka et al. | |
| 7,570,911 | B2 | 8/2009 | Nakafuji et al. | |
| 7,583,922 | B2 | 9/2009 | Takashi et al. | |
| 7,603,049 | B2 | 10/2009 | Kishi et al. | |
| 7,609,988 | B2 | 10/2009 | Kishi et al. | |
| 7,664,410 | B2 | 2/2010 | Takagi | |
| 7,840,150 | B2 * | 11/2010 | Mori et al. | 399/69 |
| 7,885,569 | B2 | 2/2011 | Kishi et al. | |
| 7,912,392 | B2 | 3/2011 | Yoshinaga et al. | |
| 7,957,663 | B2 | 6/2011 | Kishi et al. | |
| 8,073,352 | B2 | 12/2011 | Kunii et al. | |
| 2003/0165348 | A1 | 9/2003 | Amita et al. | |
| 2004/0037595 | A1 | 2/2004 | Takashi et al. | |
| 2004/0245241 | A1 | 12/2004 | Kishi et al. | |
| 2004/0247332 | A1 | 12/2004 | Kishi et al. | |
| 2004/0247334 | A1 | 12/2004 | Kishi et al. | |
| 2004/0258426 | A1 | 12/2004 | Kishi et al. | |
| 2005/0025534 | A1 | 2/2005 | Fujita et al. | |
| 2005/0025537 | A1 | 2/2005 | Echigo et al. | |
| 2005/0117943 | A1 | 6/2005 | Nakafuji et al. | |
| 2005/0139584 | A1 | 6/2005 | Kishi et al. | |
| 2005/0152721 | A1 | 7/2005 | Kikuchi et al. | |
| 2005/0158075 | A1 | 7/2005 | Echigo et al. | |
| 2005/0175368 | A1 | 8/2005 | Matsusaka et al. | |
| 2005/0175370 | A1 | 8/2005 | Matsusaka et al. | |
| 2005/0191078 | A1 | 9/2005 | Kishi et al. | |
| 2005/0201783 | A1 | 9/2005 | Kurotaka et al. | |
| 2005/0207801 | A1 | 9/2005 | Kunii et al. | |
| 2005/0286920 | A1 | 12/2005 | Baba et al. | |
| 2007/0104520 | A1 | 5/2007 | Nakafuji et al. | |
| 2007/0212090 | A1 | 9/2007 | Matsusaka et al. | |
| 2008/0145088 | A1 | 6/2008 | Matsusaka et al. | |
| 2008/0219716 | A1 | 9/2008 | Takashi et al. | |
| 2008/0253789 | A1 | 10/2008 | Yoshinaga et al. | |
| 2009/0123172 | A1 | 5/2009 | Kishi et al. | |
| 2009/0169232 | A1 | 7/2009 | Kunii et al. | |
| 2009/0230615 | A1 * | 9/2009 | Wong et al. | 271/227 |
| 2009/0245903 | A1 * | 10/2009 | Nakamura et al. | 399/341 |
| 2009/0317113 | A1 | 12/2009 | Kishi et al. | |
| 2010/0232818 | A1 | 9/2010 | Kunii | |
| 2011/0064494 | A1 * | 3/2011 | Amita et al. | 399/341 |
| 2011/0085815 | A1 | 4/2011 | Kishi et al. | |
| 2011/0129248 | A1 * | 6/2011 | Shiozawa | 399/82 |
| 2011/0176822 | A1 | 7/2011 | Ishii et al. | |
| 2011/0188911 | A1 | 8/2011 | Kunii et al. | |
| 2012/0008153 | A1 | 1/2012 | Kunii et al. | |
| 2013/0149017 | A1 * | 6/2013 | Amita et al. | 399/341 |

FOREIGN PATENT DOCUMENTS

| | | | |
|---|---|---|---|
| JP | 2002091048 | A | 3/2002 |
| JP | 2002099168 | A | 4/2002 |
| JP | 2003-270987 | A | 9/2003 |
| JP | 2005084109 | A | 3/2005 |
| JP | 2006243444 | A | 9/2006 |
| JP | 2007-108464 | A | 4/2007 |
| JP | 2007-114488 | A | 5/2007 |

OTHER PUBLICATIONS

Abstract of JP 2005-084109 published Mar. 31, 2005.
Abstract of JP 2006-243444 published Sep. 14, 2006.
Abstract of JP 2002-091048 published Mar. 27, 2002.
Abstract of JP 2002-099168 published Apr. 5, 2002.
Abstract of JP 2003-270987 published Sep. 25, 2003.
Japanese Office Action for Japanese Patent Application No. 2011-043958, mailed on Mar. 27, 2015.
Office Action dated Nov. 14. 2014 from corresponding Japanese Patent Application No. 2011-043958.

* cited by examiner

GLOSS APPLIER AND IMAGE FORMING APPARATUS INCORPORATING SAME

CROSS-REFERENCE TO RELATED APPLICATIONS

This patent application is based on and claims priority pursuant to 35 U.S.C. §119 to Japanese Patent Application No. 2011-043958, filed on Mar. 1, 2011, in the Japanese Patent Office, the entire disclosure of which is hereby incorporated herein by reference.

FIELD OF THE INVENTION

Example embodiments generally relate to a gloss applier and an image forming apparatus, and more particularly, to a gloss applier for applying gloss to a toner image on a recording medium and an image forming apparatus including the gloss applier.

BACKGROUND OF THE INVENTION

Related-art image forming apparatuses, such as copiers, facsimile machines, printers, or multifunction printers having at least one of copying, printing, scanning, and facsimile functions, typically form an image on a recording medium according to image data. Thus, for example, a charger uniformly charges a surface of an image carrier; an optical writer emits a light beam onto the charged surface of the image carrier to form an electrostatic latent image on the image carrier according to the image data; a development device supplies toner to the electrostatic latent image formed on the image carrier to render the electrostatic latent image visible as a toner image; the toner image is directly transferred from the image carrier onto a recording medium or is indirectly transferred from the image carrier onto a recording medium via an intermediate transfer member; a cleaner then collects residual toner not transferred and remaining on the surface of the image carrier after the toner image is transferred from the image carrier onto the recording medium; finally, a fixing device applies heat and pressure to the recording medium bearing the toner image to fix the toner image on the recording medium, thus forming the image on the recording medium.

The fixing device used in such image forming apparatuses may employ a heating roller and a pressing roller pressed against the heating roller to form a nip therebetween through which the recording medium bearing the toner image is conveyed. As the recording medium passes through the nip, the heating roller heated by a heater and the pressing roller apply heat and pressure to the recording medium, thus melting the toner image on the recording medium. After the recording medium is discharged from the nip, the melted toner image is cooled and solidified on the recording medium. However, since the melted toner image is cooled by air at ambient temperature, the surface of the toner image is waved, applying insufficient gloss to the toner image.

To address this problem, a fixing device having a gloss application mechanism is proposed. For example, an endless belt formed into a loop is stretched over a plurality of rollers including a heating roller heated by a heater, which in turn heats the endless belt. A pressing roller is pressed against the heating roller via the endless belt to form a nip between the pressing roller and the endless belt. As a recording medium bearing a toner image is conveyed through the nip, the endless belt heated by the heating roller and the pressing roller apply heat and pressure to the recording medium, thus melting the toner image on the recording medium. A cooler, such as a heat sink, is disposed inside the loop formed by the endless belt and downstream from the nip in the conveyance direction of the recording medium. As the recording medium discharged from the nip and in contact with the outer circumferential surface of the endless belt is conveyed by the endless belt, the cooler contacting the inner circumferential surface of the endless belt cools the recording medium via the endless belt. Since the toner image on the recording medium is cooled and solidified while it contacts the smooth outer circumferential surface of the endless belt, the surface of the toner image is not waved, thus attaining desired gloss of the toner image.

On the other hand, it is requested that the endless belt is warmed up to a target temperature of about 160 degrees centigrade in a shortened time. However, it takes longer for the endless belt in contact with the cooler to be heated to the target temperature because the cooler draws heat from the endless belt. Moreover, it is necessary to liberate the heat drawn to the cooler so that the cooler is ready to cool the recording medium, resulting in decreased thermal efficiency.

SUMMARY OF THE INVENTION

At least one embodiment may provide a gloss applier that includes an endless belt formed into a loop and rotatable in a predetermined direction of rotation; a heating roller disposed inside the loop formed by the endless belt to heat the endless belt; a heater disposed inside the heating roller to heat the heating roller; a pressing rotary body rotatable in a direction counter to the direction of rotation of the endless belt and pressed against the heating roller via the endless belt to form a nip between the pressing rotary body and the endless belt through which a recording medium bearing a toner image is conveyed, the endless belt and the pressing rotary body to apply heat and pressure to the recording medium to melt the toner image on the recording medium; a cooler disposed inside the loop formed by the endless belt and downstream from the heating roller in the direction of rotation of the endless belt, the cooler to separatably contact and cool the endless belt as the recording medium in contact with the endless belt is conveyed by the endless belt; a separation roller disposed inside the loop formed by the endless belt and downstream from the cooler in the direction of rotation of the endless belt, the separation roller to separate the recording medium from the endless belt; and a cooler shifter contacting the cooler to move the cooler bidirectionally to cause the cooler to contact and separate from the endless belt.

At least one embodiment may provide a gloss applier that includes an endless belt formed into a loop and rotatable in a predetermined direction of rotation; a heating roller disposed inside the loop formed by the endless belt to heat the endless belt; a heater disposed inside the heating roller to heat the heating roller; a pressing rotary body rotatable in a direction counter to the direction of rotation of the endless belt and pressed against the heating roller via the endless belt to form a nip between the pressing rotary body and the endless belt through which a recording medium bearing a toner image is conveyed, the endless belt and the pressing rotary body to apply heat and pressure to the recording medium to melt the toner image on the recording medium; a cooling fan disposed inside the loop formed by the endless belt and downstream from the heating roller in the direction of rotation of the endless belt, the cooling fan to blow air to the endless belt to cool the endless belt as the recording medium in contact with the endless belt is conveyed by the endless belt; and a separation roller disposed inside the loop formed by the endless belt and downstream from the cooling fan in the direction of rotation of the endless belt, the separation roller to separate the recording medium from the endless belt.

At least one embodiment may provide an image forming apparatus that includes the gloss applier described above and a fixing device that includes a fixing rotary body rotatable in a predetermined direction of rotation and heated by a heater; and a pressing rotary body rotatable in a direction counter to the direction of rotation of the fixing rotary body and pressed against the fixing rotary body to form a nip therebetween through which a recording medium bearing a toner image is conveyed. The fixing rotary body and the pressing rotary body apply heat and pressure to the recording medium to melt the toner image on the recording medium as the recording medium is conveyed through the nip. The gloss applier is disposed adjacent to and downstream from the fixing device in a conveyance direction of the recording medium with a distance therebetween that allows the melted toner image to deform by an external force.

Additional features and advantages of example embodiments will be more fully apparent from the following detailed description, the accompanying drawings, and the associated claims.

BRIEF DESCRIPTION OF THE DRAWINGS

A more complete appreciation of example embodiments and the many attendant advantages thereof will be readily obtained as the same becomes better understood by reference to the following detailed description when considered in connection with the accompanying drawings, wherein.

Figure 1:
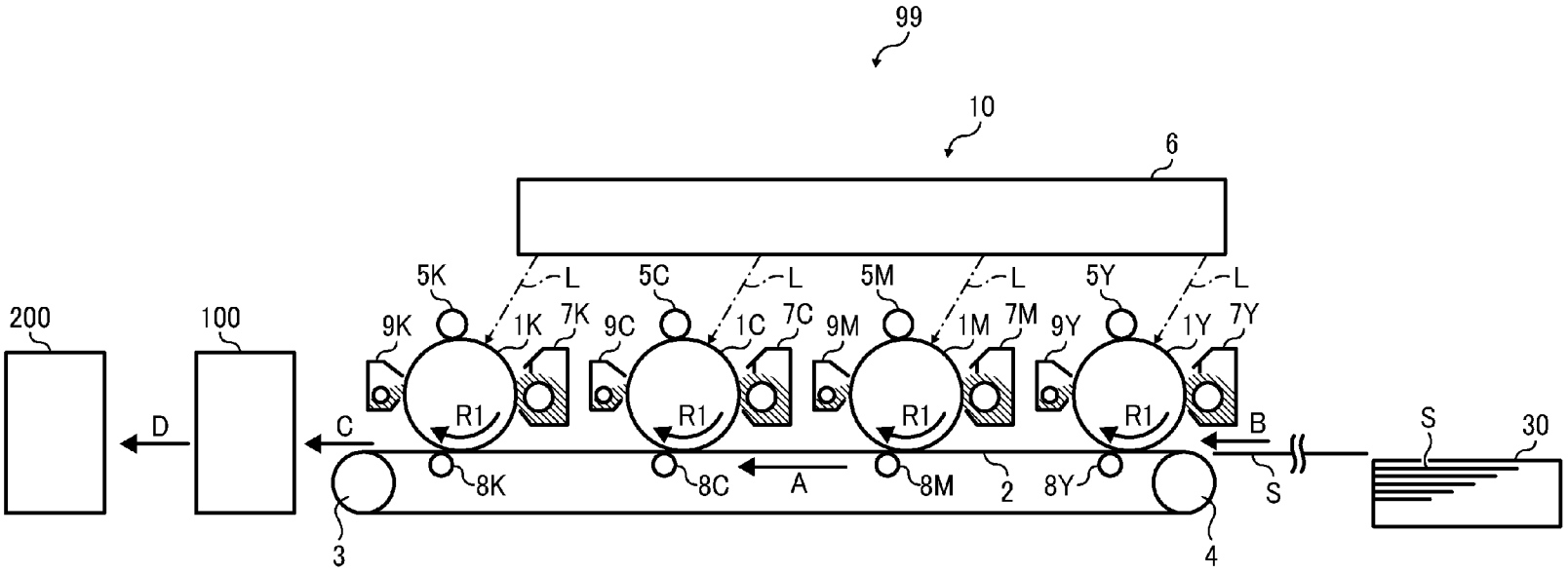
FIG. 1 is a schematic vertical sectional view of an image forming apparatus according to an example embodiment.

The accompanying drawings are intended to depict example embodiments and should not be interpreted to limit the scope thereof. The accompanying drawings are not to be considered as drawn to scale unless explicitly noted.

DETAILED DESCRIPTION OF THE INVENTION

It will be understood that if an element or layer is referred to as being "on", "against", "connected to", or "coupled to" another element or layer, then it can be directly on, against, connected or coupled to the other element or layer, or intervening elements or layers may be present. In contrast, if an element is referred to as being "directly on", "directly connected to", or "directly coupled to" another element or layer, then there are no intervening elements or layers present. Like numbers refer to like elements throughout. As used herein, the term "and/or" includes any and all combinations of one or more of the associated listed items.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors used herein are interpreted accordingly.

Although the terms first, second, etc. may be used herein to describe various elements, components, regions, layers and/or sections, it should be understood that these elements, components, regions, layers and/or sections should not be limited by these terms. These terms are used only to distinguish one element, component, region, layer, or section from another region, layer, or section. Thus, a first element, component, region, layer, or section discussed below could be termed a second element, component, region, layer, or section without departing from the teachings of the present invention.

The terminology used herein is for the purpose of describing particular embodiments only and is not intended to be limiting of the present invention. As used herein, the singular forms "a", "an", and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing example embodiments illustrated in the drawings, specific terminology is employed for the sake of clarity. However, the disclosure of this specification is not intended to be limited to the specific terminology so selected and it is to be understood that each specific element includes all technical equivalents that operate in a similar manner.

Referring now to the drawings, wherein like reference numerals designate identical or corresponding parts throughout the several views, particularly to FIG. 1, an image forming apparatus 99 according to an example embodiment is explained.

FIG. 1 is a schematic vertical sectional view of the image forming apparatus 99. The image forming apparatus 99 may be a copier, a facsimile machine, a printer, a multifunction printer having at least one of copying, printing, scanning, plotter, and facsimile functions, or the like. According to this example embodiment, the image forming apparatus 99 is a color printer for forming an image on a recording medium by electrophotography.

The image forming apparatus 99 includes a paper tray 30 that loads a plurality of recording media S (e.g., plain paper, resin sheets, and resin film sheets), an image forming device 10 that forms a toner image on a recording medium S conveyed from the paper tray 30, a fixing device 100 that fixes the toner image on the recording medium S, and a gloss applier 200 that applies gloss to the toner image on the recording medium S.

A detailed description is now given of the structure of the image forming device 10.

The image forming device 10 includes drum-shaped photoconductors 1Y, 1M, 1C, and 1K; charging rollers 5Y, 5M, 5C, and 5K, development devices 7Y, 7M, 7C, and 7K, and cleaners 9Y, 9M, 9C, and 9K that surround the photoconductors 1Y, 1M, 1C, and 1K, respectively; a writing unit 6 disposed above the photoconductors 1Y, 1M, 1C, and 1K; a transfer belt 2 formed into a loop disposed below and opposite the photoconductors 1Y, 1M, 1C, and 1K; a driving roller 3 and a driven roller 4 over which the transfer belt 2 is stretched; and transfer rollers 8Y, 8M, 8C, and 8K disposed inside the loop formed by the transfer belt 2 and opposite the photoconductors 1Y, 1M, 1C, and 1K.

A detailed description is now given of the operation of the image forming device 10 having the structure described above.

Since identical toner image forming operations are performed on the photoconductors 1Y, 1M, 1C, and 1K, yellow toner image forming operations performed on the photoconductor 1Y are described below. Accordingly, magenta, cyan, and black toner image forming operations performed on the photoconductors 1M, 1C, and 1K are omitted.

As the photoconductor 1Y rotates clockwise in FIG. 1 in a rotation direction R1, the charging roller 5Y uniformly charges an outer circumferential surface of the photoconductor 1Y at a predetermined polarity. The writing unit 6 emits a laser beam L optically modulated based on image data sent from an external device such as a client computer onto the charged outer circumferential surface of the photoconductor 1Y, thus exposing the charged outer circumferential surface of the photoconductor 1Y and forming an electrostatic latent image thereon. Then, the development device 7Y supplies yellow toner to the electrostatic latent image formed on the photoconductor 1Y, visualizing the electrostatic latent image into a yellow toner image.

On the other hand, the driving roller 3 drives and rotates the transfer belt 2 counterclockwise in FIG. 1 in a rotation direction A. A recording medium S conveyed from the paper tray 30 in a direction B is further conveyed on the transfer belt 2 and enters a transfer nip formed between the photoconductor 1Y and transfer belt 2. As the transfer roller 8Y disposed opposite the photoconductor 1Y via the transfer belt 2 is applied with a voltage having a polarity opposite a polarity of the yellow toner of the yellow toner image formed on the photoconductor 1Y, the transfer roller 8Y transfers the yellow toner image from the photoconductor 1Y onto the recording medium S. After the transfer of the yellow toner image, the cleaner 9Y removes residual toner not transferred onto the recording medium S and therefore remaining on the photoconductor 1Y therefrom.

Similarly, magenta, cyan, and black toner images are formed on the photoconductors 1M, 1C, and 1K, respectively, and transferred onto the recording medium S conveyed on the transfer belt 2 successively in such a manner that the magenta, cyan, and black toner images are superimposed on the yellow toner image. Thus, a color toner image is formed on the recording medium S. Thereafter, the recording medium S bearing the color toner image is conveyed in a direction C to the fixing device 100. The fixing device 100 applies heat and pressure to the recording medium S, melting and fixing the color toner image on the recording medium S. The recording medium S discharged from the fixing device 100 is conveyed in a recording medium conveyance direction D to an output tray so that a user picks up the recording medium S bearing the fixed color toner image from the output tray. Alternatively, the recording medium S discharged from the fixing device 100 is conveyed through the gloss applier 200 described below if the user selects a gloss application mode that produces a glossy toner image. In the gloss application mode, the recording medium S discharged from the gloss applier 200 is conveyed to the output tray.

It is to be noted that the recording medium S is conveyed in the horizontal directions B, C, and D in FIG. 1. Alternatively, the recording medium S may be conveyed in directions other than the horizontal direction, for example, through a curved conveyance path.

Figure 2:
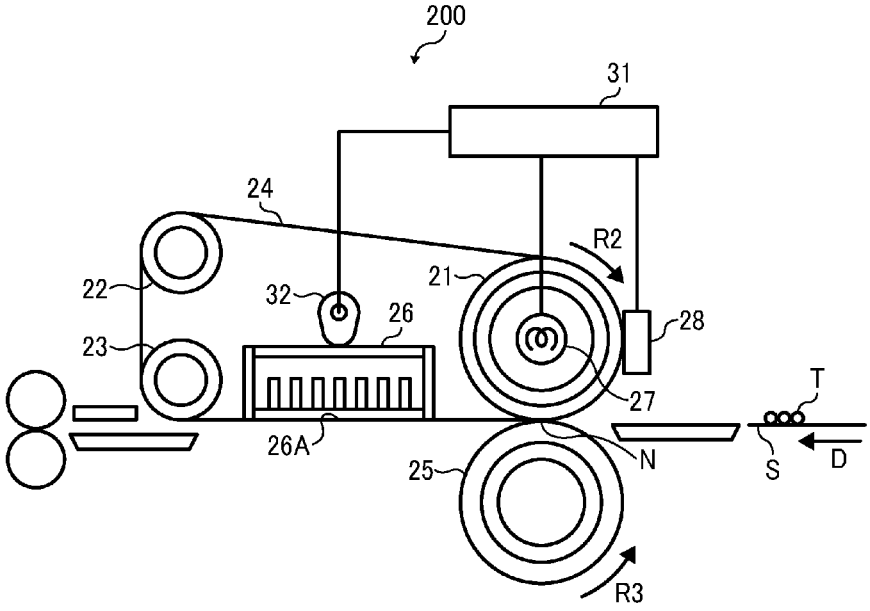
FIG. 2 is a vertical sectional view of a gloss applier installed in the image forming apparatus shown in FIG. 1 in a cooling mode.
Figure 3:
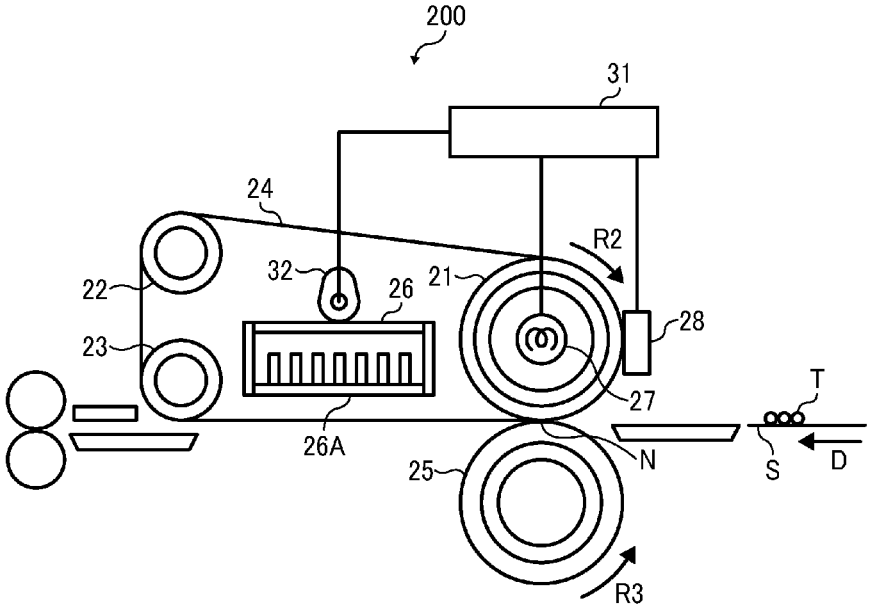
FIG. 3 is a vertical sectional view of the gloss applier shown in FIG. 2 in a non-cooling mode.

Referring to FIGS. 2 and 3, the following describes the structure of the gloss applier 200 installed in the image forming apparatus 99 described above.

The gloss applier 200 accommodates a cooling mode used to apply gloss to a toner image T on a recording medium S and a non-cooling mode used to warm up the gloss applier 200. FIG. 2 is a vertical sectional view of the gloss applier 200 in the cooling mode. FIG. 3 is a vertical sectional view of the gloss applier 200 in the non-cooling mode.

As shown in FIG. 1, the gloss applier 200 is disposed downstream from the fixing device 100 in the recording medium conveyance direction D and spaced apart from the fixing device 100 with a substantial distance therebetween. As shown in FIG. 2, the gloss applier 200 includes an endless belt 24 formed into a loop; a heating roller 21, a support roller 22, and a separation roller 23 over which the endless belt 24 is stretched; a pressing roller 25, serving as a pressing rotary body, pressed against the heating roller 21 via the endless belt 24; a halogen heater 27 disposed inside the heating roller 21; a thermistor 28, serving as a temperature detector, disposed opposite the heating roller 21 via the endless belt 24; and a heat sink 26, serving as a cooler, disposed inside the loop formed by the endless belt 24. For example, one of the heating roller 21, the support roller 22, and the separation roller 23 drives and rotates the endless belt 24 clockwise in FIG. 2 in a rotation direction R2.

A moving mechanism that moves the pressing roller 25 with respect to the heating roller 21 presses the pressing roller 25 against the heating roller 21 via the endless belt 24, forming a nip N between the pressing roller 25 and the endless belt 24 through which the recording medium S is conveyed and having a predetermined length in the recording medium conveyance direction D. As the endless belt 24 rotates in the rotation direction R2, the pressing roller 25 rotates in a rotation direction R3 counter to the rotation direction R2 of the endless belt 24 by friction between the endless belt 24 and the pressing roller 25.

The heat sink 26 serving as a cooler is disposed downstream from the nip N and upstream from the separation roller 23 in the rotation direction R2 of the endless belt 24, that is, in the recording medium conveyance direction D, in such a manner that the heat sink 26 is disposed opposite an inner circumferential surface of the endless belt 24.

The halogen heater 27 disposed inside the heating roller 21 serves as a heater that heats the heating roller 21. The thermistor 28 disposed opposite the heating roller 21 via the endless belt 24 serves as a temperature detector that detects a temperature of an outer circumferential surface of the endless belt 24. The thermistor 28 is operatively connected to a controller 31, that is, a central processing unit (CPU) provided with a random-access memory (RAM) and a read-only memory (ROM), for example. The controller 31 is operatively connected to the halogen heater 27 to turn on and off the halogen heater 27 based on the temperature of the endless belt 24 detected by the thermistor 28 so that the outer circumferential surface of the endless belt 24 has a target temperature (e.g., about 150 degrees centigrade).

The separation roller 23 over which the endless belt 24 is stretched curves the endless belt 24 at a predetermined curvature, facilitating separation of the recording medium S from the endless belt 24, which is conveyed from the nip N to the separation roller 23 in a state in which the recording medium S contacts the outer circumferential surface of the endless belt 24.

The heat sink 26 cools the endless belt 24 immediately after the endless belt 24 passes through the nip N as well as the recording medium S in contact with the endless belt 24. For example, the heat sink 26 includes a plurality of radiation fins in parallel with each other arranged in an axial direction of the endless belt 24 orthogonal to the rotation direction R2 of the endless belt 24. An opposed face 26A of the heat sink 26 disposed opposite the inner circumferential surface of the endless belt 24 presses against the endless belt 24 to cool the endless belt 24.

A heat sink shifter 32 operatively connected to the controller 31 and contacting the heat sink 26 serves as a cooler shifter that moves the heat sink 26 with respect to the endless belt 24. For example, in the cooling mode, the controller 31 controls the heat sink shifter 32 to cause the heat sink 26 to contact the inner circumferential surface of the endless belt 24 as shown in FIG. 2. By contrast, in the non-cooling mode, the controller 31 controls the heat sink shifter 32 to separate the heat sink 26 from the endless belt 24 as shown in FIG. 3. For example, the heat sink shifter 32 may be a cam assembly including a cam. Specifically, the cam is rotatably mounted on each of flanges provided on lateral ends of the endless belt 24 in the axial direction thereof. When the cam is at the position shown in FIG. 2, it lowers the heat sink 26, causing the heat sink 26 to contact the endless belt 24. Conversely, when the cam is at the position shown in FIG. 3, it lifts the heat sink 26, thus separating the heat sink 26 from the endless belt 24.

A detailed description is now given of the operation of the gloss applier 200 having the structure described above.

If the user selects the gloss application mode that produces a glossy toner image, the controller 31 warms up the gloss applier 200 to a target temperature (e.g., about 150 degrees centigrade) from room temperature. That is, the controller 31 heats the endless belt 24 to the target temperature. For example, the controller 31 turns on the halogen heater 27 to heat the heating roller 21 that in turn heats the endless belt 24 until the thermistor 28 detects that the surface temperature of the endless belt 24 reaches the target temperature. Simultaneously, one of the heating roller 21, the support roller 22, and the separation roller 23 drives and rotates the endless belt 24 which in turn rotates the pressing roller 25. Although the pressing roller 25 has no heater inside it, as it rotates in accordance with rotation of the endless belt 24, it is uniformly heated by heat conduction from the endless belt 24.

During warm-up of the gloss applier 200, as shown in FIG. 3, the gloss applier 200 is in the non-cooling mode. Specifically, the heat sink shifter 32 separates the opposed face 26A of the heat sink 26 from the endless belt 24. If the heat sink 26 is already isolated from the endless belt 24, the heat sink 26 remains isolated from the endless belt 24. Thus, although the heat sink 26 is made of a heat conductive material, when the opposed face 26A of the heat sink 26 is isolated from the endless belt 24 during warm-up of the gloss applier 200, the heat sink 26 does not draw heat from the endless belt 24. Accordingly, the endless belt 24 is warmed up to the target temperature quickly.

By contrast, when the endless belt 24 is heated to the target temperature and therefore warming up of the gloss applier 200 is finished, the recording medium S is conveyed to the gloss applier 200. Simultaneously, the gloss applier 200 enters the cooling mode in which the opposed face 26A of the heat sink 26 contacts the endless belt 24. However, if the surface temperature of the endless belt 24 reaches a gloss application temperature (e.g., 150 degrees centigrade) required to apply gloss to the toner image T and at the same time the opposed face 26A of the heat sink 26 contacts the endless belt 24, the surface temperature of the endless belt 24 may decrease from the gloss application temperature immediately after the heat sink 26 contacts the endless belt 24. To address this problem, the controller 31 switches from the non-cooling mode to the cooling mode when the surface temperature of the endless belt 24 reaches a temperature higher than the gloss application temperature required to apply gloss to the toner image T, for example, about 155 degrees centigrade by about 5 degrees centigrade higher than the gloss application temperature of about 150 degrees centigrade. Accordingly, even if the surface temperature of the endless belt 24 decreases when the heat sink 26 comes into contact with the endless belt 24, the surface temperature of the endless belt 24 is maintained at the gloss application temperature of about 150 degrees centigrade required to apply gloss to the toner image T, attaining desired gloss of the toner image T on the recording medium S.

As described above, as the gloss applier 200 enters the cooling mode upon completion of warm-up of the gloss applier 200, the recording medium S bearing the toner image T is conveyed through the nip N formed between the pressing roller 25 and the endless belt 24. As the recording medium S passes through the nip N where the endless belt 24 is at about 150 degrees centigrade, the endless belt 24 heats and melts the toner image T on the recording medium S. Thereafter, the recording medium S bearing the melted toner image T is conveyed to the heat sink 26 in a state in which the recording medium S contacts the endless belt 24. According to this example embodiment, the distance between the nip N and the separation roller 23 in the recording medium conveyance direction D is about 120 mm. While the recording medium S in contact with the endless belt 24 is conveyed through the distance of about 120 mm, the recording medium S is cooled by the heat sink 26. As a result, when the recording medium S reaches the separation roller 23, the temperature of the recording medium S is decreased to about 40 degrees centigrade lower than a glass transition temperature of toner of the toner image T on the recording medium S. That is, the toner image T is cooled and solidified on the recording medium S while the toner image T contacts the endless belt 24. Thereafter, the separation roller 23 separates the recording medium S bearing the solidified toner image T from the endless belt 24. Consequently, the glossy toner image T having a gloss level of about 80 percent is formed on the recording medium S.

Figure 4:
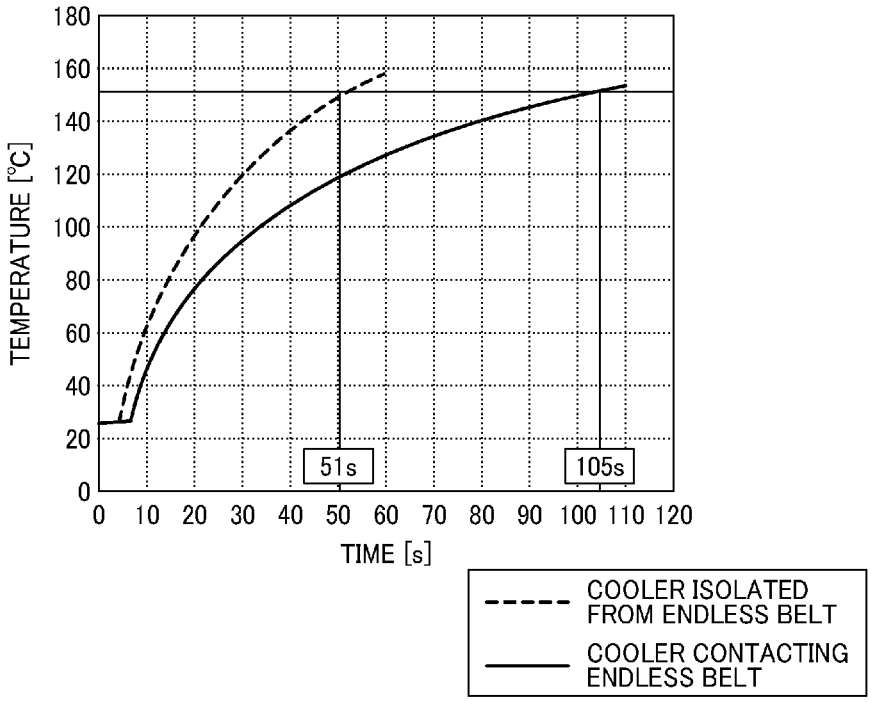
FIG. 4 is a graph showing a relation between a time for which an endless belt incorporated in the gloss applier shown in FIG. 2 is heated and a surface temperature of the endless belt.

FIG. 4 is a graph showing the relation between the heating time for which the halogen heater 27 heats the endless belt 24 via the heating roller 21 and the surface temperature of the endless belt 24 detected by the thermistor 28.

Measurement results shown in FIG. 4 are obtained with the heating roller 21 having an outer diameter of 35 mm and the halogen heater 27 applied with 500 watts of power. As shown in FIG. 4, if the halogen heater 27 heats the endless belt 24 in the cooling mode in which the heat sink 26 contacts the endless belt 24, it takes about 105 seconds to heat the endless belt 24 from room temperature to the target temperature of about 150 degrees centigrade. By contrast, if the halogen heater 27 heats the endless belt 24 in the non-cooling mode in which the heat sink 26 is isolated from the endless belt 24, it takes only about 51 seconds to heat the endless belt 24 from room temperature to the target temperature of about 150 degrees centigrade. Thus, if the gloss applier 200 is warmed up in the non-cooling mode, the warm-up time is reduced by half compared to in the cooling mode. For example, the warm-up time of about 51 seconds in the non-cooling mode is reduced by about 54 seconds from the warm-up time of about 105 seconds in the cooling mode.

The gloss applier 200 shown in FIGS. 2 and 3 employs the heat sink 26 as a cooler that cools the endless belt 24. Alternatively, a cooling fan that blows air to the heat sink 26 or a Peltier device, that is, a semiconductor device using Peltier effect, may be employed as a cooler that cools the endless belt 24.

Figure 5:
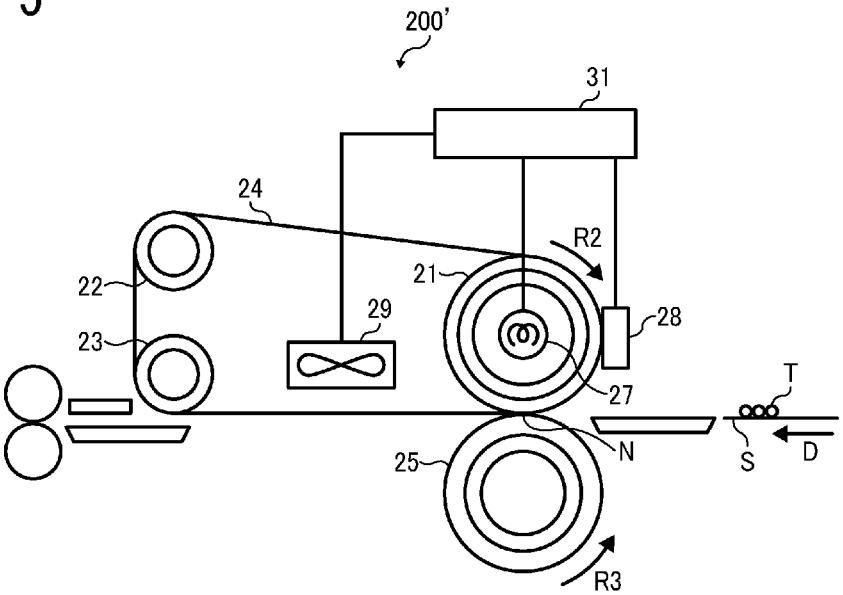
FIG. 5 is a vertical sectional view of a gloss applier according to another example embodiment.

Referring to FIG. 5, the following describes an alternative example of a cooler that cools the endless belt 24.

FIG. 5 is a vertical sectional view of a gloss applier 200' including a cooling fan 29 instead of the heat sink 26 shown in FIG. 2 as a cooler that cools the endless belt 24. As shown in FIG. 5, the cooling fan 29 is disposed inside the loop formed by the endless belt 24 to blow air to the endless belt 24, thus cooling the endless belt 24. When the gloss applier 200' enters the non-cooling mode to warm up itself, the controller 31 operatively connected to the cooling fan 29 turns off the cooling fan 29. If the cooling fan 29 has already been turned off, the cooling fan 29 remains turned off. By contrast, when the surface temperature of the endless belt 24 detected by the thermistor 28 reaches a target temperature higher than the gloss application temperature required to apply gloss to the toner image T upon completion of warm-up of the gloss applier 200', the controller 31 turns on the cooling fan 29 in the cooling mode.

Figure 6:
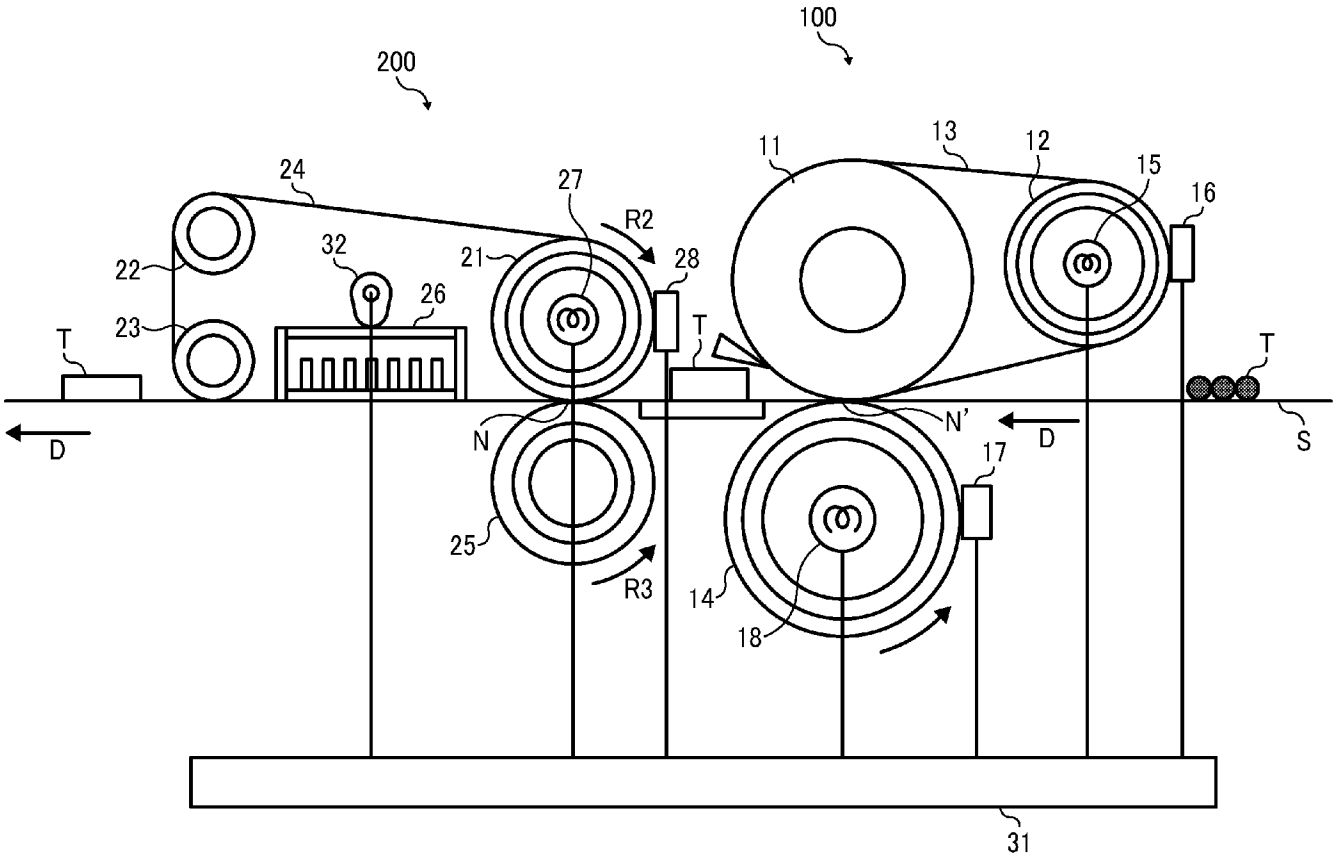
FIG. 6 is a vertical sectional view of the gloss applier shown in FIG. 2 and a fixing device installed in the image forming apparatus shown in FIG. 1.

Referring to FIG. 6, the following describes a configuration in which the gloss applier 200 shown in FIG. 2 is disposed adjacent to and downstream from the fixing device 100 in the recording medium conveyance direction D.

FIG. 6 is a vertical sectional view of the fixing device 100 and the gloss applier 200 disposed downstream from the fixing device 100 in the recording medium conveyance direction D. As shown in FIG. 6, the fixing device 100 (e.g., a fuser unit) includes a fixing belt 13, serving as a fixing rotary body, formed into a loop stretched over a fixing roller 11 and a heating roller 12; a pressing roller 14, serving as a pressing rotary body, pressed against the fixing roller 11 via the fixing belt 13 to form a nip N' between the pressing roller 14 and the fixing belt 13; a halogen heater 15 disposed inside the heating roller 12 to heat the heating roller 12; a thermistor 16 disposed opposite the heating roller 12 via the fixing belt 13 to detect the temperature of an outer circumferential surface of the fixing belt 13; a halogen heater 18 disposed inside the pressing roller 14 to heat the pressing roller 14; and a thermistor 17 disposed opposite an outer circumferential surface of the pressing roller 14 to detect the temperature of the pressing roller 14.

The controller 31 operatively connected to the halogen heater 15 and the thermistor 16 turns on and off the halogen heater 15 based on the surface temperature of the fixing belt 13 detected by the thermistor 16. The controller 31 also operatively connected to the halogen heater 18 and the thermistor 17 turns on and off the halogen heater 18 based on the surface temperature of the pressing roller 14 detected by the thermistor 17. With the configuration described above, the fixing device 100 fixes a toner image T on a recording medium S as the recording medium S is conveyed through the nip N' formed between the pressing roller 14 and the fixing belt 13.

The gloss applier 200 shown in FIG. 6 is spaced apart from the fixing device 100 in the recording medium conveyance direction D within a distance that allows the recording medium S discharged from the fixing device 100 to reach the gloss applier 200 in a state in which the toner image T melted by the fixing device 100 is deformable by an external force. Since the hot recording medium S heated by the fixing device 100 reaches the gloss applier 200, the gloss applier 200 needs not heat the recording medium S to a temperature high enough to melt the toner image T on the recording medium S. For example, even if the target temperature of the endless belt 24 is about 120 degrees centigrade, the gloss applier 200 shown in FIG. 6 attains a gloss level of the toner image T formed on the recording medium S equivalent to that of the gloss applier 200 shown in FIG. 2 spaced apart from the fixing device 100 with a substantial distance therebetween. Accordingly, the lower target temperature of the endless belt 24 shortens the time required to warm up the gloss applier 200. For example, in the non-cooling mode in which the heat sink 26 is isolated from the endless belt 24, it takes only about 30 seconds to heat the endless belt 24 of the gloss applier 200 shown in FIG. 6 to the target temperature of about 120 degrees centigrade. That is, the gloss applier 200 shown in FIG. 6 reduces the warm-up time by 21 seconds from the warm-up time of the gloss applier 200 shown in FIG. 2, which is obtained by subtracting 30 seconds of the warm-up time of the gloss applier 200 shown in FIG. 6 from 51 seconds of the warm-up time of the gloss applier 200 shown in FIG. 2.

It is to be noted that the gloss applier 200' shown in FIG. 5 may also be spaced apart from the fixing device 100 in the recording medium conveyance direction D within a distance that allows the recording medium S discharged from the fixing device 100 to reach the gloss applier 200' in a state in which the toner image T melted by the fixing device 100 is deformable by an external force.

The following describes advantages of the configurations described above.

As shown in FIGS. 2, 3, and 6, the gloss applier 200 switches between the cooling mode in which the heat sink 26 serving as a cooler contacts the endless belt 24, thus cooling the endless belt 24 and the non-cooling mode in which the heat sink 26 is isolated from the endless belt 24, thus not cooling the endless belt 24. For example, during warm-up, that is, before the recording medium S enters the nip N formed between the endless belt 24 and the pressing roller 25, the gloss applier 200 is in the non-cooling mode in which the heating roller 21 heated by the halogen heater 27 heats the endless belt 24 rotating in the rotation direction R2 while the heat sink 26 is isolated from the endless belt 24 as shown in FIG. 3, thus not cooling the endless belt 24.

In the non-cooling mode, heat conducted from the heating roller 21 heated by the halogen heater 27 to the endless belt 24 is not drawn to the heat sink 26. Accordingly, the non-cooling mode allows the endless belt 24 to be heated more effectively compared to the cooling mode in which heat is conducted from the endless belt 24 to the heat sink 26 in contact with the endless belt 24 as shown in FIG. 2. Consequently, the endless belt 24 is heated to the target temperature within a shortened time.

The heat sink shifter 32 serves as a cooler shifter that moves the heat sink 26 serving as a cooler between a cooling position where the heat sink 26 contacts the endless belt 24 in the cooling mode as shown in FIG. 2 and a non-cooling position where the heat sink 26 is isolated from the endless belt 24 in the non-cooling mode as shown in FIG. 3. During warm-up, that is, before the nip N is heated to the target temperature, the heat sink shifter 32 separates the heat sink 26 from the endless belt 24 in the non-cooling mode as shown in FIG. 3. Accordingly, the non-cooling mode allows the endless belt 24 to be heated to the target temperature within a shortened time compared to the cooling mode in which the heat sink 26 contacts the endless belt 24, thus shortening the warm-up time of the gloss applier 200.

By contrast, after the endless belt 24 is heated to the target temperature, the heat sink shifter 32 moves the heat sink 26 to contact the endless belt 24 in the cooling mode while the heating roller 21 heats the endless belt 24. As a recording medium S bearing an unfixed toner image T is conveyed through the nip N, the heating roller 21 melts the toner image T. Then, as the recording medium S in contact with the outer circumferential surface of the endless belt 24 is conveyed below the heat sink 26 in contact with the inner circumferential surface of the endless belt 24, the heat sink 26 cools and solidifies the melted toner image T on the recording medium S. Thereafter, the separation roller 23 separates the recording medium S bearing the solidified toner image T from the endless belt 24. Thus, the glossy toner image T is formed on the recording medium S.

The target temperature of the endless belt 24 is higher than the gloss application temperature that applies gloss to the toner image T. The gloss applier 200 switches from the non-cooling mode to the cooling mode after the endless belt 24 is heated to the target temperature higher than the gloss application temperature required to apply gloss to the toner image T. Accordingly, even if the temperature of the endless belt 24 is decreased immediately after the gloss applier 200 enters the cooling mode by the heat sink 26 that draws heat from the endless belt 24, the gloss applier 200 applies desired gloss to the toner image T on the recording medium S.

As shown in FIG. 5, the gloss applier 200' switches between the cooling mode and the non-cooling mode by turning on and off the cooling fan 29 serving as a cooler that cools the endless belt 24. For example, during warm-up of the gloss applier 200', that is, before the endless belt 24 is heated to the target temperature, the controller 31 turns off the cooling fan 29 in the non-cooling mode. Accordingly, the non-cooling mode allows the endless belt 24 to be heated to the target temperature within a shortened time compared to the cooling mode in which the cooling fan 29 is turned on to blow air to the endless belt 24, thus shortening the warm-up time of the gloss applier 200'.

By contrast, after the endless belt 24 is heated to the target temperature, the controller 31 turns on the cooling fan 29 in the cooling mode. In the cooling mode, the toner image T on the recording medium S is melted at the nip N, and then cooled and solidified by the cooling fan 29. Thereafter, the recording medium S bearing the solidified toner image T is separated from the endless belt 24 by the separation roller 23. Thus, the glossy toner image T is formed on the recording medium S.

The target temperature of the endless belt 24 is higher than the gloss application temperature that applies gloss to the toner image T. The gloss applier 200' switches from the non-cooling mode to the cooling mode after the endless belt 24 is heated to the target temperature higher than the gloss application temperature required to apply gloss to the toner image T. Accordingly, even if the temperature of the endless belt 24 is decreased immediately after the gloss applier 200' enters the cooling mode due to air blown from the cooling fan 29 against the endless belt 24, the gloss applier 200' applies desired gloss to the toner image T on the recording medium S.

As shown in FIG. 6, the gloss applier 200 may be disposed adjacent to and downstream from the fixing device 100 in the recording medium conveyance direction D. Specifically, the gloss applier 200 is spaced apart from the fixing device 100 in the recording medium conveyance direction D within a distance that allows the recording medium S discharged from the fixing device 100 to reach the gloss applier 200 in a state in which the toner image T melted by the fixing device 100 is deformable by an external force. Accordingly, the gloss applier 200 heats the recording medium S bearing the deformable toner image T at a decreased temperature, shortening the warm-up time required to warm up the gloss applier 200.

As described above, the gloss applier (e.g., the gloss appliers 200 and 200') switches between the cooling mode in which the cooler (e.g., the heat sink 26 and the cooling fan 29) cools the endless belt 24 and the non-cooling mode in which the cooler does not cool the endless belt 24. For example, during warm-up of the gloss applier, that is, before the endless belt 24 is heated to the target temperature, the controller 31 selects the non-cooling mode. The non-cooling mode prevents the cooler from drawing heat from the endless belt 24 heated by the heater (e.g., the halogen heater 27) via the heating roller 21. Accordingly, the endless belt 24 is heated to the target temperature in a shortened time compared to the cooling mode. Consequently, the gloss applier is warmed up in a shortened time.

By contrast, after the endless belt 24 is heated to the target temperature, the controller 31 selects the cooling mode in which the cooler cools the endless belt 24. In the cooling mode, the cooler cools and solidifies the toner image T melted at the nip N as the recording medium S bearing the toner image T is conveyed through the nip N. Thereafter, the separation roller 23 separates the recording medium S bearing the solidified toner image T from the endless belt 24. Thus, the glossy toner image T is formed on the recording medium S.

With the configurations described above, the gloss applier is warmed up efficiently in a shortened time. The image forming apparatus 99 installed with the gloss applier forms the glossy toner image T on the recording medium S effectively.

As shown in FIG. 1, the yellow, magenta, cyan, and black toner images are directly transferred from the photoconductors 1Y, 1M, 1C, and 1K onto the recording medium S. Alternatively, the image forming apparatus 99 may further include an intermediate transferor (e.g., an intermediate transfer belt) via which the yellow, magenta, cyan, and black toner images are transferred onto the recording medium S. For example, the yellow, magenta, cyan, and black toner images are transferred onto the intermediate transferor successively in such a manner that the yellow, magenta, cyan, and black toner images are superimposed on the same position on the intermediate transferor, thus forming a color toner image on the intermediate transferor. Then, the color toner image is transferred from the intermediate transferor onto the recording medium S.

As shown in FIGS. 2, 3, 5, and 6, the pressing roller 25 serves as a pressing rotary body pressed against the heating roller 21 via the endless belt 24 to form the nip N between the pressing roller 25 and the endless belt 24. Alternatively, a pressing belt stretched over a plurality of rollers may serve as a pressing rotary body. As shown in FIG. 6, the fixing belt 13 serves as a fixing rotary body and the pressing roller 14 serves as a pressing rotary body pressed against the fixing rotary body to form the nip N' therebetween. Alternatively, a fixing roller may serve as a fixing rotary body and a pressing belt may serve as a pressing rotary body.

The present invention has been described above with reference to specific example embodiments. Nonetheless, the present invention is not limited to the details of example embodiments described above, but various modifications and improvements are possible without departing from the spirit and scope of the present invention. It is therefore to be understood that within the scope of the associated claims, the present invention may be practiced otherwise than as specifically described herein. For example, elements and/or features of different illustrative example embodiments may be combined with each other and/or substituted for each other within the scope of the present invention.

What is claimed is:

1. A gloss applier comprising:

an endless belt formed into a loop and rotatable in a predetermined direction of rotation;

a heating roller disposed inside the loop formed by the endless belt to heat the endless belt;

a heater disposed inside the heating roller to heat the heating roller;

a pressing rotary body rotatable in a direction counter to the direction of rotation of the endless belt and pressed against the heating roller via the endless belt to form a nip between the pressing rotary body and the endless belt through which a recording medium bearing a toner image is conveyed, the endless belt and the pressing rotary body to apply heat and pressure to the recording medium to melt the toner image on the recording medium;

a cooler disposed inside the loop formed by the endless belt and downstream from the heating roller in the direction of rotation of the endless belt, the cooler to separatably contact and cool the endless belt as the recording medium in contact with the endless belt is conveyed by the endless belt;

a separation roller disposed inside the loop formed by the endless belt and downstream from the cooler in the direction of rotation of the endless belt, the separation roller to separate the recording medium from the endless belt; and a cooler shifter contacting the cooler to move the cooler bidirectionally to cause the cooler to contact and separate from the endless belt, wherein the cooler shifter separates the cooler from the endless belt before the temperature of the endless belt reaches a target temperature and causes the cooler to contact the endless belt after the temperature of the endless belt reaches the target temperature, wherein during a warm-up of the gloss applier from an ambient temperature, the gloss applier is in a non-cooling mode where the cooler shifter separates the cooler from the endless belt until the endless belt reaches the target temperature, wherein the target temperature is higher than a gloss application temperature, the gloss application temperature being a required temperature that is needed in order to apply gloss to the toner image on the recording medium.

2. The gloss applier according to claim 1, further comprising a temperature detector disposed opposite the endless belt to detect the temperature of the endless belt.

3. The gloss applier according to claim 2, wherein the temperature detector includes a thermistor.

4. The gloss applier according to claim 1, wherein the heater includes a halogen heater.

5. The gloss applier according to claim 1, wherein the pressing rotary body includes one of a pressing roller and a pressing belt.

6. The gloss applier according to claim 1, wherein the cooler includes a heat sink.

7. The gloss applier according to claim 1, wherein the cooler shifter includes a cam.

8. An image forming apparatus comprising:

the gloss applier according to claim 1; and a fixing device comprising:

a fixing rotary body rotatable in a predetermined direction of rotation and heated by a heater; and a pressing rotary body rotatable in a direction counter to the direction of rotation of the fixing rotary body and pressed against the fixing rotary body to form a nip therebetween through which a recording medium bearing a toner image is conveyed, the fixing rotary body and the pressing rotary body to apply heat and pressure to the recording medium to melt the toner image on the recording medium as the recording medium is conveyed through the nip, wherein the gloss applier is disposed adjacent to and downstream from the fixing device in a conveyance direction of the recording medium with a distance therebetween that allows the melted toner image to deform by an external force.

9. The image forming apparatus according to claim 8, wherein the fixing rotary body includes one of a fixing roller and a fixing belt and the pressing rotary body includes one of a pressing roller and a pressing belt.

10. The gloss applier of claim 1, wherein the cooler shifter is configured to maintain a contact surface of the cooler in a plane that is about parallel to a lower section of the endless belt throughout a range of motion of the cooler.

* * * * *